United States Patent [19]

Lin

[11] Patent Number: 4,671,084

[45] Date of Patent: Jun. 9, 1987

[54] PUSH BUTTON TYPE COMBINATION LOCK

[76] Inventor: Yung S. Lin, No. 69, Lane 77, Sec. 1, An Ho Rd., Tainan, Taiwan

[21] Appl. No.: 749,093

[22] Filed: Jun. 26, 1985

[51] Int. Cl.[4] ..... E05B 37/14; E05B 37/18

[52] U.S. Cl. ..... 70/25; 70/288; 70/298

[58] Field of Search ..... 70/25, 22, 24, 26, 297, 70/298, 299, 287, 288

[56] References Cited

U.S. PATENT DOCUMENTS 2,497,619 2/1950 Mass ..... 70/25

2,549,882 4/1951 Berger ..... 70/25

4,476,698 10/1984 Treslo ..... 70/25

*Primary Examiner*—Robert L. Wolfe

*Attorney, Agent, or Firm*—Robert B. Frailey

[57] ABSTRACT

An improved combination lock of the push button type which consists of three improvements. Firstly, its sliding member is not in direct contact with the latch which locks the hook, so that even an adroit lock-picker finds it difficult to find the correct code. Secondly, it is provided with a device to reset all the depressed buttons. Thirdly, the characters corresponding to the combination buttons are coated with phosphorescent material so as to enable one to discriminate the characters in the dark.

14 Claims, 16 Drawing Figures

PUSH BUTTON TYPE COMBINATION LOCK

This invention relates to an improved combination lock of the push button type.

Before entering our topic, I must first define three terms which are to be used throughout the specification and the claims. Please refer to the inset of FIG. 1. The three dimensions of a lock are respectively defined as H-, W-, and T-direction, wherein H refers to the "height direction", W refers to the "width direction", and T, the "thickness direction."

DETAILED DESCRIPTION OF PREFERRED EMBODIMENT

Figure 1:
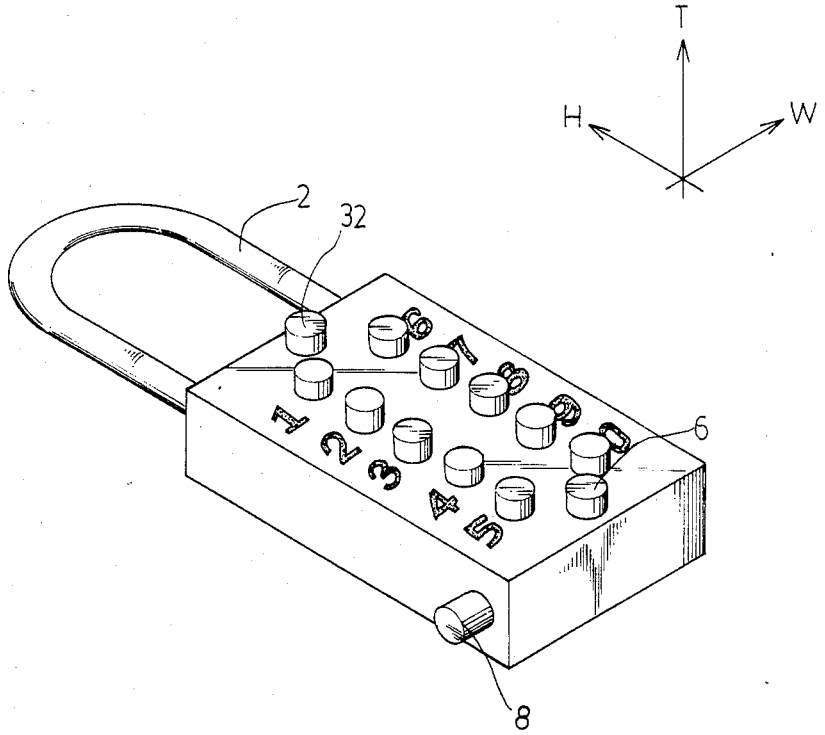
FIG. 1 is a perspective view of a pushing button type combination lock according to this invention.

FIG. 1 illustrates the preferred embodiment of the push button type of combination lock embodying this invention, including the usual lock housing, a plurality of control buttons and the usual hook (2).

This invention differs from conventional pushing button combination locks in three respects: (A) an indirect mechanical connection between the latch and the sliding member, (B) an improved pushing button mechanism, and (C) phosphorescent characters. They will be separately described hereinbelow:

A. Indirect connection between the latch and sliding member

Figure 2:
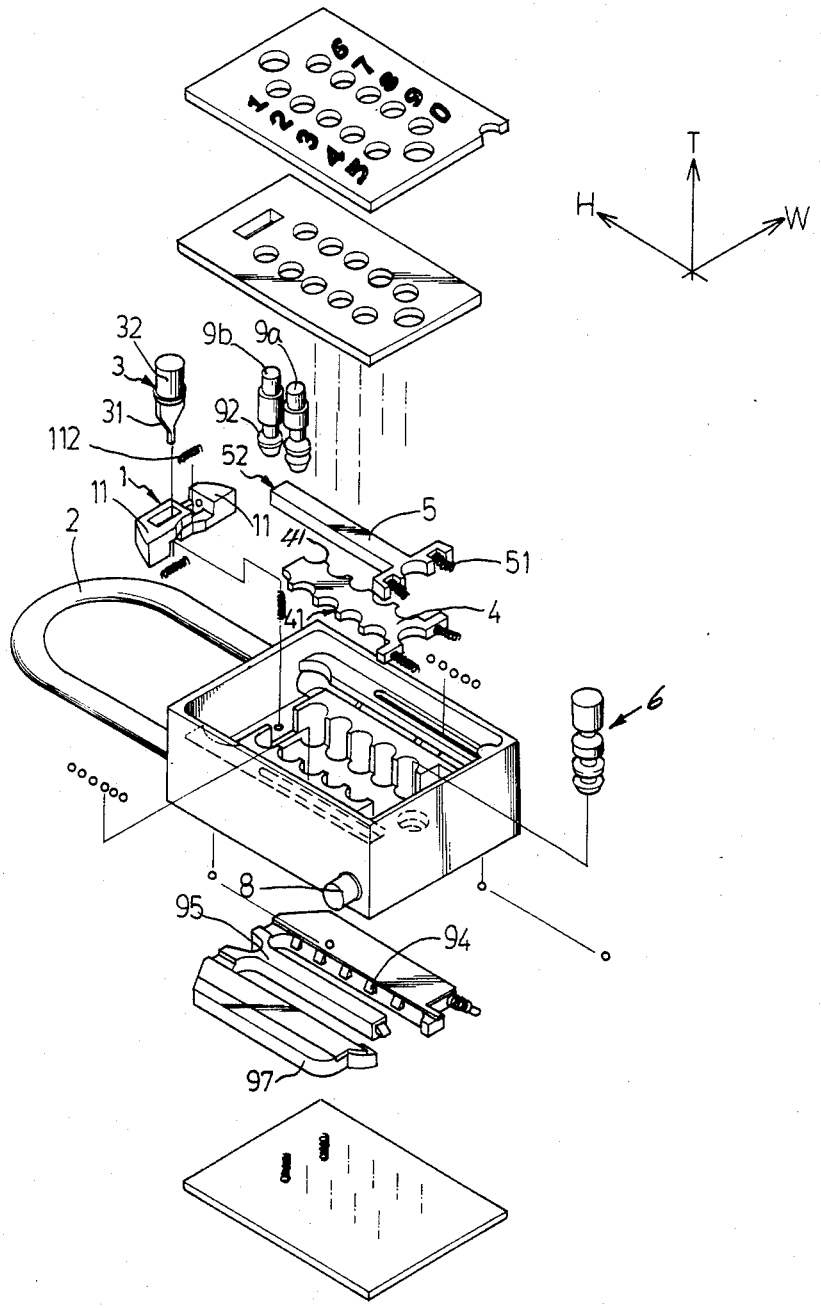
FIG. 2 is an exploded view of the pushing button type combination lock.
Figure 3:
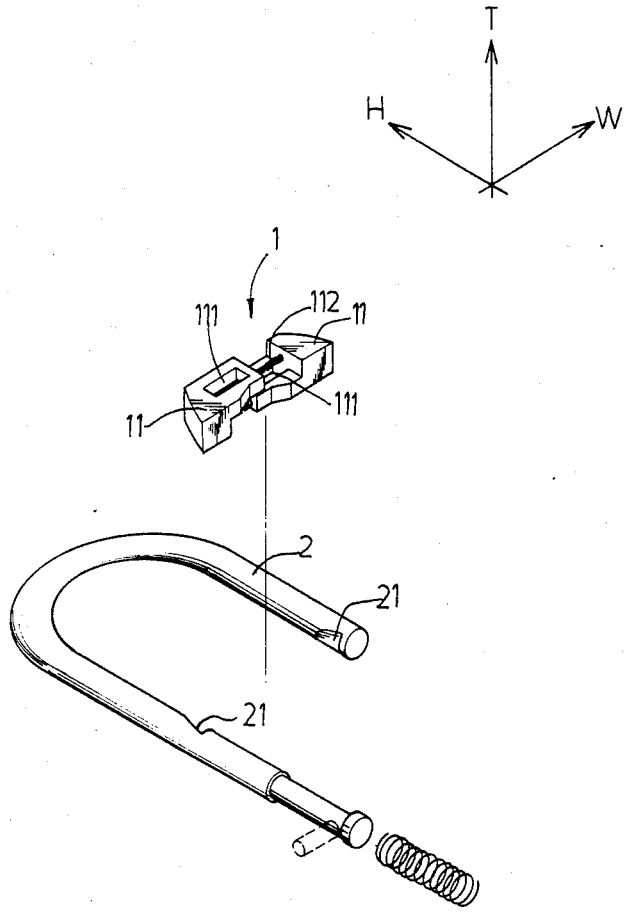
FIG. 3 is a perspective view showing the latch members according to this invention, and the corresponding hook.
Figure 4:
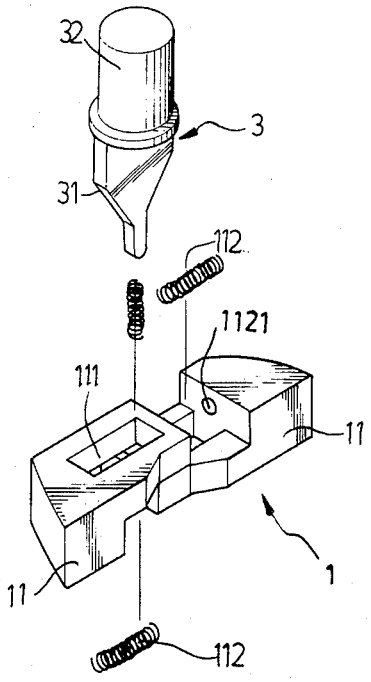
FIG. 4 is a perspective view of the two overlapping latch members and the intermediate element.
Figure 5A:
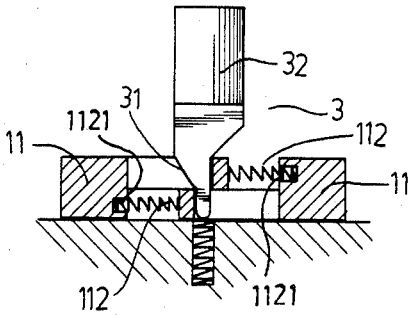
FIGS. 5A and 5B show the relationship between the latch members and the intermediate element.
Figure 5B:
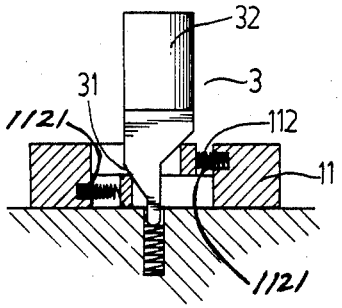
Figure 7:
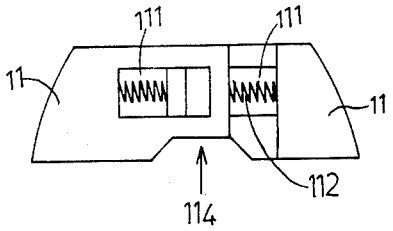
FIG. 7 is a plan view of two overlapping latch members.
Figure 6:
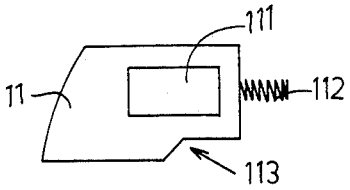
FIG. 6 is a plan view of a latch member.

Referring to the drawings and in particular to FIGS. 2, 3 and 4 thereof, the latch (1) according to this invention comprises two identical latch members (11), disposed in overlapping relationship, with their tip ends pointing in opposite directions. Just like a conventional latch, latch members (11) are resiliently retained in a path in the W-direction to move a short distance to respectively engage into a notch (21) on each leg of a hook (2). An intermediate element (3) is disposed between the latch members (11), which can move a small distance in perpendicular to the latch members (11) (see FIGS. 5A and 5B). A displacement of the intermediate element (3) causes the two latch members (11) to move toward the hook (2) or away from it. For this purpose, each of the two latch members (11) has an elongate slot (111) (best shown in FIG. 6) extending along the direction of its movement (W-direction), whereas the intermediate element (3) has a tapering lower portion (31) which can be inserted into the slots (111). The two slots (111) cooperate to define a tunnel for the tapering portion (31) of intermediate element (3). The passable width of the tunnel becomes narrower when the two latch members (11) are forced apart from each other. To offer the latch members (11) a tendency to move toward their locking position, there are provided two springs (112), each of which has one end received in a recess (1121). Thus normally the latch members (11) are resiliently biased toward their locking positions, leaving the narrowest passable width of the tunnel. The upper end of intermediate element (3) emerges out of the housing of the lock in the form of an accessory button (32) (See FIG. 1). When it is pushed down in the T-direction, the narrow tunnel is forced to widen by the insertion of the tapering portion (31) of intermediate element (3). Because the latch members (11) overlap in position, the two notches (113) define a recess (114), which widens when the two latch members (11) move away from each other (see FIGS. 6 and 7). The recess (114) has two inclined sides, so that the front end (52) of a spring biased sliding member (5) can easily enter.

Figures 9A, 9B:
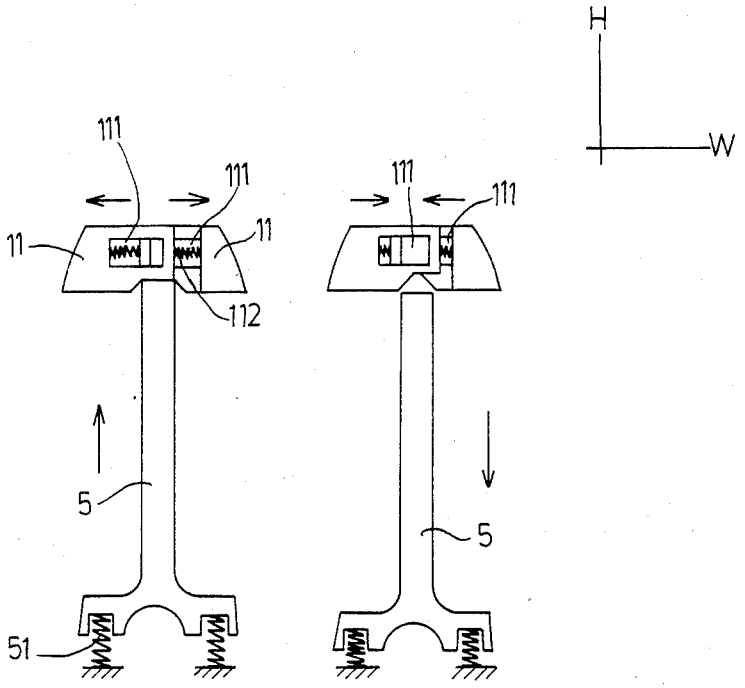
FIGS. 9A, 9B show the relationship between the second sliding member and the latch members.

With reference to FIGS. 9A and 9B, only the sliding member (5) is directly in contact with the latch members (11). The sliding member (5) can slide away from the recess (114) only when a spring biased first sliding member (4) is released. Practically, the lock is provided with a second accessory button (6) (See FIG. 1), which can be pressed down only when the first sliding member (4) is released. And only when the second accessory button (6) is pressed can the second sliding member (5) be retracted to allow one to press down the first accessory button (32) to unlock the lock.

Figure 8A:
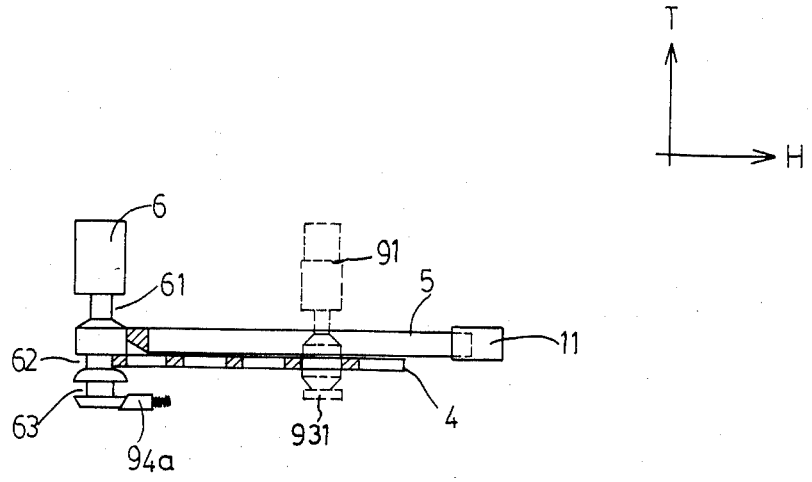
FIGS. 8A, 8B show the relationship among the first sliding member, the second sliding member, and the second accessory button.
Figure 8B:
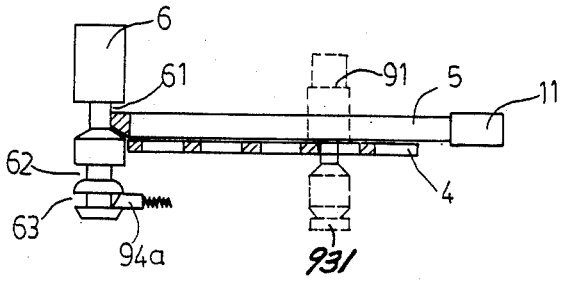

FIGS. 8A and 8B show the relationship between the first and second sliding members (4) and (5) and the second accessory button (6), which functions as a security means.

The second accessory button (6) has an upper annular slot (61) and an intermediate annular groove (62). The second sliding member (5) is positioned on the first sliding member (4). When the combination buttons are not correctly pressed, the first sliding member (4) is restrained from moving by incorrectly positioned button columns (91) (only one is shown in broken lines in FIGS. 8A and 8B) and remains in groove (62) so that the second accessory button (6) cannot be pressed down (See FIG. 8A.). And the second sliding member (5) forces the overlapping latch members (11) to separate and remain in their locking positions; thus the lock remains in locked state (see FIG. 9A). When the combination buttons are correctly pressed, the first sliding member (4) is no longer restrained by any combination button, and is resiliently biased to slide away from the groove (62). Now one can push the second accessory button (6) down, so that the second sliding member (5) is in alignment with slot (61) (see FIG. 8B). Then the first accessory button (32) can be pressed down to unlock the lock, and since the depression of button (32) will cause the two latch members (11) to come closer and therefore cause the recess (114) to dwindle, the end of the second sliding member (5) is squeezed out of the recess (114) against the springs (51), and the opposite end of second sliding member (5) engages into the slot (61) (See FIG. 8B). A retaining means is provided to retain the second accessory button (6) in its depressed position. The retaining means is a spring-loaded check (94*a*) which bites into a lower annular groove (63) at the lower end of button (6). Thus, in this modification, to unlock the lock, one has to push the correct combination keys, then push the second accessory button (6), so that the first accessory button (32) can be pressed down to unlock the lock. One must keep depressing the first accessory button (32) until the hook (2) is sprung out.

Having thus clearly described the indirect mechanical connection between the latch members (11) and the sliding members (4) and (5) in detail, now I will describe the improved pushing button mechanism hereinafter. B. Improved push button mechanism This mechanism consists in two aspects:

(a) When a combination push button is pressed down, it must be retained in its depressed position; otherwise the upper end of its column (91) (which serves as the combination button) will emerge from the lock housing.

(b) There is provided a third accessory button reset button (8) (See FIG. 1). When the reset button (8) is pressed, all the depressed combination buttons will be released and resume their original positions.

Figure 11A:
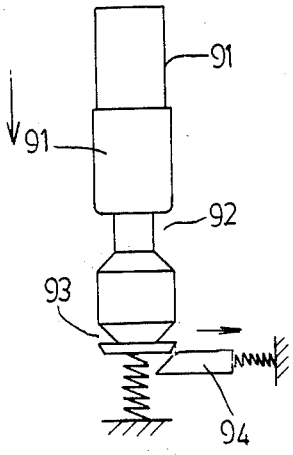
FIGS. 11A, 11B show the relationship between a retaining means and a column.
Figure 11B:
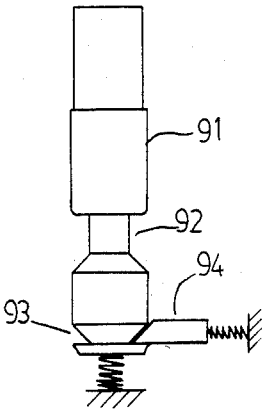

The lower end of a column (91), i.e. the end opposite to its pushing end, is biased by a spring which resiliently pushes it upward to its high position (see FIGS. 11A and 11B). There is provided retaining means (94) for each of the combination buttons which can engage with the groove (93) of the pushing button column (91) and retain the column in its depressed position. There is further provided releasing means which releases the retention of said retaining means so that a depressed button may resume its original high position.

FIGS. 8A and 8B illustrate an example to achieve such function.

Figure 10:
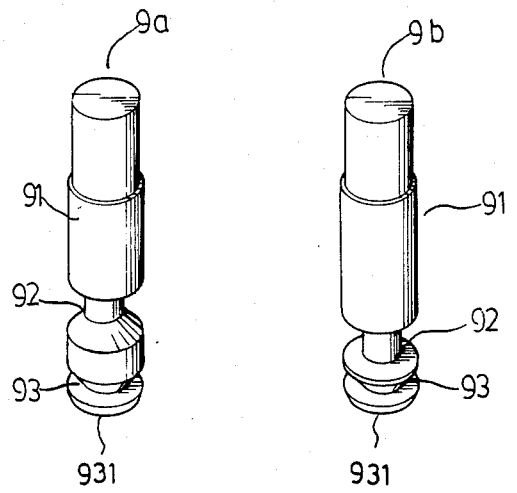
FIG. 10 shows the two types of combination pushing buttons.
Figure 12:
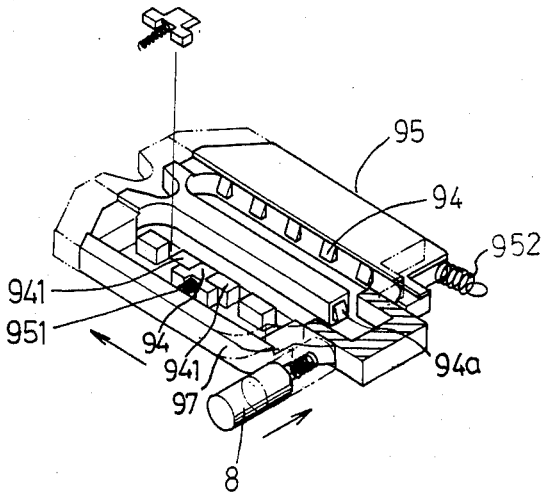
FIG. 12 shows how the sliding piece is moved by the third accessory button.

Like the conventional push button type lock, this invention comprises a plurality of combination push buttons. Depending on the position of their upper annular slots (92), there are two groups of slightly different combination buttons (9*a*) and (9*b*) (see FIGS. 2, 10). The slot (92) of button (9*b*) is in alignment with the projections (41) of the first sliding member (4) when the button is not depressed, while the slot (92) of button (9*a*) is in alignment with the projections (41) when depressed. However, unlike the columns of the conventional push button lock, each of the button columns (91) has an annular groove (93) at its lower end. There is provided a corresponding retaining means for each column (9*a*) or (9*b*) comprising a spring-loaded check (94). When a push button column (91) is depressed in the T-direction, the check (94) is pushed aside in the W-direction by the end (931) of column (91) and then resiliently returns and bites into the annular groove (93) of the column (See FIGS. 11A and 11B) and retains the latter in depressed position. All the checks (94) are mounted on a sliding piece (95) (see FIGS. 2 and 12) which can be actuated by the reset button (8) to slide a small distance in the H-direction. FIG. 12 shows a preferred embodiment of such sliding piece (95). Each check (94) is retained between two blocks (941) integrally formed on the sliding piece (95), and is loaded with a spring (951) to achieve its function. The sliding piece (95) has two slots running in the H-direction to allow the columns (91) to pass through. The sliding piece (95) is biased by spring means (952) to remain in the position where the depressed combination buttons can be retained by the checks (94). When one presses the reset button (8) the sliding piece (95) is forced to move a small distance in the H-direction thus all the depressed buttons are released. The preferable way to achieve this function is for the sliding piece (95) to have a sloped shoulder (97) (best shown in FIG. 2) so that it can be easily pushed by the reset button (8) in the H-direction. The check (94*a*) for the second accessory button (6) is preferably provided at the sliding piece (95).

Thus when one resets the depressed combination buttons, he meanwhile releases the second accessory button (6). However, when the sliding piece (95) is pushed to release the depressed buttons, the second accessory button must be released before the releasing of the depressed combination buttons. This is self-evident, since the first sliding member (4) is pushed by the rising columns (91) against its biasing spring to resume engagement with the groove (62) of the second accessory button (6). If the second accessory button (6) rises too late, this desired procedure will not occur smoothly. This is only a term of engineering design, and can be easily achieved by proper dimensioning, thus detailed description is not necessary.

It is noteworthy, that the lower end portion of each button (9*a*) or (9*b*) has a beveled lower margin and a flat upper side. This structure enables the button to push away the check (94), when the button is pushed downward. On the other hand, the groove (95) has a beveled upper margin and a flat lower face to match the shape of the check (94). The second accessory button (6) is provided with like means for the same purpose. Referring to FIGS. 8A and 8B, the lower end of the second accessory button (6) is similar to that of a button (9*a*) or (9*b*). It has a beveled lower margin and a lower groove (63) so that when it is pressed down, it can be retained in place by a corresponding check (94*a*) on the sliding piece (95). And when one pushes reset button (8) to shift sliding piece (95), the second accessory button (6) also is released and resiliently rises to the high position. Since its upper slot (61) has a beveled lower margin, it can push the second sliding member (5) to its locking position shown in FIG. 9A.

When the correct combination buttons are depressed, the first sliding member (4) resiliently retracts from the grooves (92) so that one can press down the second accessory button (6), which is then retained in its depressed position by the check (94*a*). Now one can push down the first accessory button (32) (and he must keep on pressing it until the hook is released). When he keeps on depressing the button (32) the latch members (11) are forced to remain in the unlocking position (FIG. 9B), and the second sliding member (5) is driven into the slot (61) (FIG. 8B). Now the hook (2) can be forced out thereby opening the lock. The first accessory button (32) resiliently rises when released. Thus, the latch members (11) almost return to their locking positions (though now they do not really "lock" the hook (2). The second sliding member (5) is resiliently pushed back into the recess (114) between the two latch members (11), and almost leaves the slot (61). But the second accessory button (6) is still retained by its retaining means (94*a*), and thus remains in its depressed state. When one desires to re-lock the lock, he must push the reset button (8) to "reset" all the depressed buttons (including the second accessory button). When one pushes the reset button (8), all the depressed buttons rise and push their corresponding projections (41) away, thus pushing the first sliding member (4) into groove (62). Now the hook (2) can be driven into the hook hole and locked therein.

The combination lock according to this invention can also be applied in various respects for motorcycles and cars as well as doors.

I claim:

1. A combination lock comprising:

(a) a housing;

(b) a hook having notch means thereon to be engaged by latch means when said hook is pushed into said housing;

(c) latch means which is spring-loaded to engage with said notch means on the hook and has following means to be engaged and driven by disengaging means, said latch means disengaging with said notch means when said following means is driven by disengaging means;

(d) disengaging means having driving means to drive said following means so as to disengage said latch means with said notch means;

(e) a plurality of combination buttons which are divided into first buttons and second buttons each having a slot, the slots of said first buttons being disposed at a different position than the slots of the second buttons;

(f) a first sliding means which is spring-loaded to disengage with security means and has lateral projections which pass the slots of said combination buttons when in alignment with each other, wherein when said first buttons are depressed, the slots thereof are in alignment with the projections of said first sliding means while the slots of said second sliding means are in alignment with said projections when the second buttons are not depressed;

(g) security means which has a lower slot to be engaged by said first sliding means and an upper slot to receive a second sliding means;

(h) second sliding means which is spring-loaded to enter the upper slot of said security means; said second sliding means being forced to enter a recess defined by said latch means to prevent said latch means from disengaging with said notch means on the hook when out of engagement with said security means;

(i) such that when the lock is locked, said first sliding means engages with the lower slot of said security means to prevent the upper slot of said security means from receiving said second sliding means, thus making said second sliding means enter the recess defined by said latch means to prevent said latch means from disengaging with said notch means; and (j) such that when the lock is to be unlocked, the first buttons are first pressed to have the slots of all the combination buttons in alignment with the projections of the first sliding means to release the first sliding means, said security means then being movable to have said second sliding means enter the upper slot thereof, thus enabling the disengaging means to disengage the latch means from the notch means on the hook.

2. A combination lock as set forth in claim 1, wherein the hook has one leg upon which the notch means is disposed.

3. A combination lock as set forth in claim 1, wherein the hook has at least two legs upon each of which the notch means is disposed.

4. A combination lock as set forth in claim 3, wherein the latch means comprises the same number of spring-loaded latch members as the legs of said hook and wherein the following means is a slot disposed on each of said latch members and the driving means is a tapering end operative to push the latch members sidewardly upon being inserted into the slots of said latch members.

5. A combination lock as set forth in claim 4, wherein when the number of the latch members is two, the latch members are overlapped by each other and have their slots match each other to form a tunnel to receive the tapering end of said disengaging means, each of said latch members further having a notch and, when overlapped by each other, the latch members forming with the notches the recess aforesaid to receive the second sliding means.

6. A combination lock as set forth in claim 5, wherein the first sliding means is a plate member having a plurality of projections on at least one side.

7. A combination lock as set forth in claim 6, wherein the security means is a column having an upper slot and a lower slot.

8. A combination lock as set forth in claim 7, wherein the second sliding means is a spring-loaded post which enters the lower slot of said security means when out of contact with said latch members.

9. A combination lock as set forth in claim 8, further comprising retaining means, said retaining means restraining said combination buttons and security means from going back to undepressed positions after being depressed.

10. A combination lock as set forth in claim 9, wherein each of the combination buttons has retaining means to be retained by said retaining means after being depressed and wherein the security means further includes retaining means to be retained by said retaining means after being depressed.

11. A combination lock as set forth in claim 10, wherein the retaining means for the combination buttons and security means are slots and the retaining means are checks to engage with said slots after the combination buttons and security means are depressed.

12. A combination lock as set forth in claim 10, wherein the retaining means for the combination buttons and security means are also slots disposed on the lowest portions of the combination buttons and the security means and the retaining means is a slidable member having two longitudinal slots and a plurality of spring-loaded checks disposed on two outer sides of said slots correspondingly to the combination buttons, said slidable member further having a spring-loaded check disposed correspondingly to said security means.

13. A combination lock as set forth in claim 12, further including means for releasing the engagements of said combination buttons and security means with said retaining means.

14. A combination lock as set forth in claim 13, wherein said means for releasing the engagements of said combination buttons and security means with said retaining means is a spring-loaded button and said slidable member as retaining means is provided with an arch shoulder which cooperates with said releasing button to move said slidable member to release all the engagements of said combination buttons and security means with said retaining means when said releasing button is depressed.

* * * * *